US007220945B1

(12) United States Patent
Wang

(10) Patent No.: US 7,220,945 B1
(45) Date of Patent: May 22, 2007

(54) OVEN

(76) Inventor: Ching-Hsiang Wang, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 11/412,788

(22) Filed: Apr. 28, 2006

(51) Int. Cl.
*A21B 1/00* (2006.01)

(52) U.S. Cl. ..... 219/392; 219/394; 219/393; 219/395; 219/411; 99/396; 99/357; 99/421 H

(58) Field of Classification Search ..... 219/391–396, 219/398, 400, 406, 408, 411, 417; 99/357, 99/421 H, 396
See application file for complete search history.

(56) References Cited

U.S. PATENT DOCUMENTS 4,441,015 A * 4/1984 Eichelberger et al. ..... 219/411
5,057,331 A * 10/1991 Levinson ..... 426/243
5,819,639 A * 10/1998 Spell ..... 99/421 H
6,038,965 A * 3/2000 Thorndyke ..... 99/340
6,131,505 A * 10/2000 Lin ..... 99/340
6,917,018 B1 * 7/2005 Wong ..... 219/404
7,138,609 B2 * 11/2006 Popeil et al. ..... 219/392

* cited by examiner

*Primary Examiner*—Shawntina Fuqua

(57) ABSTRACT

An oven includes a main body, a toast tray, a baking pan, a door, a control panel, a bottom base and a shaft. In using, just put toasts to be baked on the toast tray and then, put the toast tray in an upper chamber of the main body and turn a change-over switch on the control panel to a toast reading. For baking small-sized foods, put such foods on a baking pan, and then put the pan in a lower chamber and turn the changeover switch to an oven reading orderly. Or, for baking a big object such as a whole chicken, it can be forked by the shaft and mounted in the lower chamber. And, via engagement of a driving gear and a driven gear, the shaft is to be rotated while baking, able to keep the chicken baked evenly so as to obtain a delicious chicken.

6 Claims, 7 Drawing Sheets

OVEN

BACKGROUND OF THE INVENTION

1. Field of the Invention

This invention relates to an oven, particularly to one able to bake toasts, small-sized objects or a whole chicken that can be rotated automatically so as to keep it baked evenly.

2. Description of the Prior Art

Commonly, a conventional oven and a toaster are always two independent electric appliances because of their different applications. The toaster used only for baking toasts is mainly provided with two bread slots in the top, a lift controller and a timer at one side. The conventional oven, on the contrary, is provided with a rather big room, a timer and a temperature controller for baking various foods such as meat, chicken, cracker and cake etc. In order to prevent energy from wasted, the conventional oven is hardly used to bake toasts, and therefore, a kitchen is usually furnished simultaneously with a toaster and an oven, so they occupy too much space. Moreover, suppose a chicken is to be baked in the conventional oven, it has first to be put on a baking tray for baking and turn over manually and indefinitely so as to keep it baked evenly, very bothersome to handle. And, each time the oven door is opened for turning over the chicken, the temperature in the oven will drop obviously, wasting energy and time for re-rising temperature. So, the invention has been revised to improve the defects mentioned above.

SUMMARY OF THE INVENTION

The objective of this invention is to offer a multi-function oven able to bake toasts or other foods as big as a whole chicken that can be even rotated automatically to keep it baked homogeneously, saving some space possibly required by a conventional toaster and a conventional and oven.

The main characteristics of the invention are a main body, a toast tray, a baking pan, a door, a control panel, a bottom base and a shaft. The main body is provided with an upper chamber, a lower chamber, a roller set correspondingly at two sidewalls of the upper chamber respectively, an inserting groove set at a top of the lower chamber, a bottom plate set at a bottom of the lower chamber, plural sandwiched grooves set correspondingly on two sidewalls of the lower chamber respectively and a driving gear installed on a sidewall of the lower chamber. The upper chamber is provided with plural air openings in the bottom for communicating with the lower chamber. Plural upper and bottom electro thermal tubes are installed in the lower chamber. The lower chamber is further provided with two stop strips set respectively at two sidewalls above the lower electro thermal tubes, keeping one stop strip aligned on a same level with the other at the other side. The toast tray set in the upper chamber is provided with a frame and a handle, with a metallic net laid in the frame. The baking pan is inserted in the inserting groove. The door is pivotally installed at the front side of the main body. The control panel located on the front side of the main body is provided with plural knobs and a changeover switch. The bottom base laid at the bottom of the main body is provided with a supporting rack, a supporting plate laid on the supporting rack and two stands installed on the supporting plate, having a groove on its top respectively. The shaft mounted on the stands of the bottom base is provided with a fork near its two ends respectively and a driven gear at one end for engaging with the driving gear of the main body.

BRIEF DESCRIPTION OF DRAWINGS

This invention is better understood by referring to the accompanying drawings, wherein.

DETAILED DESCRIPTION OF THE PREFERRED EMBODIMENT

Figure 1:
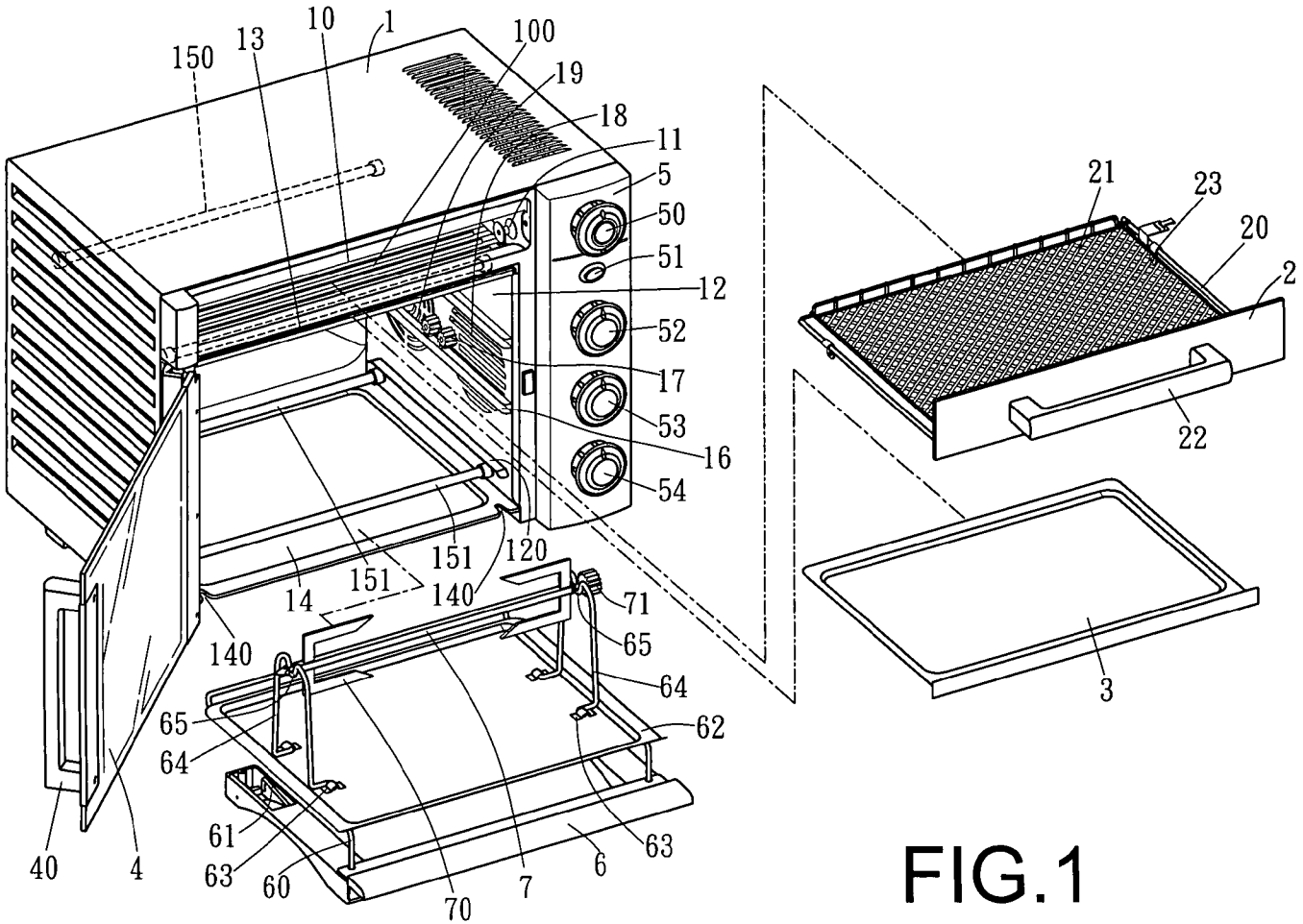
FIG. 1 is an exploded perspective view of a preferred embodiment of an oven in the present invention.
Figure 2:
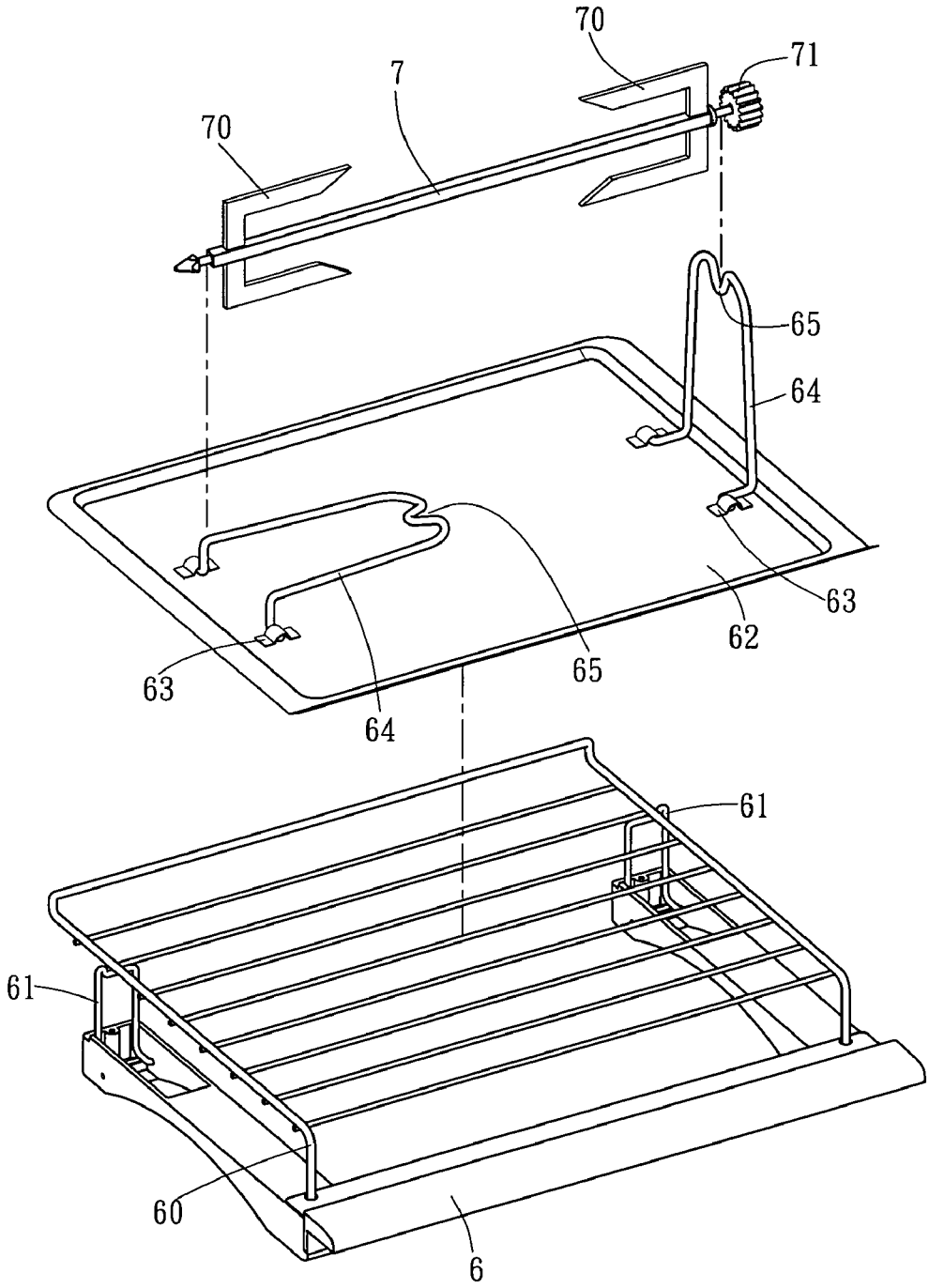
FIG. 2 is an exploded perspective view of a bottom base of an oven in the present invention.
Figure 3:
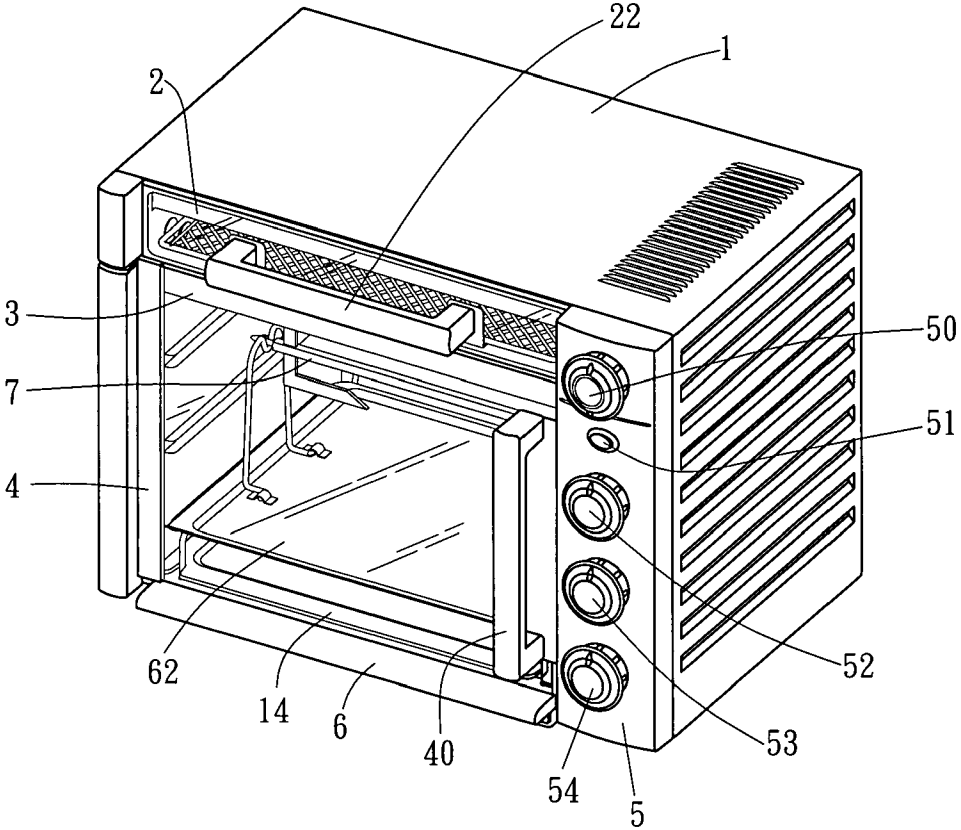
FIG. 3 is a perspective view of the preferred embodiment of an oven in the present invention.
Figure 4:
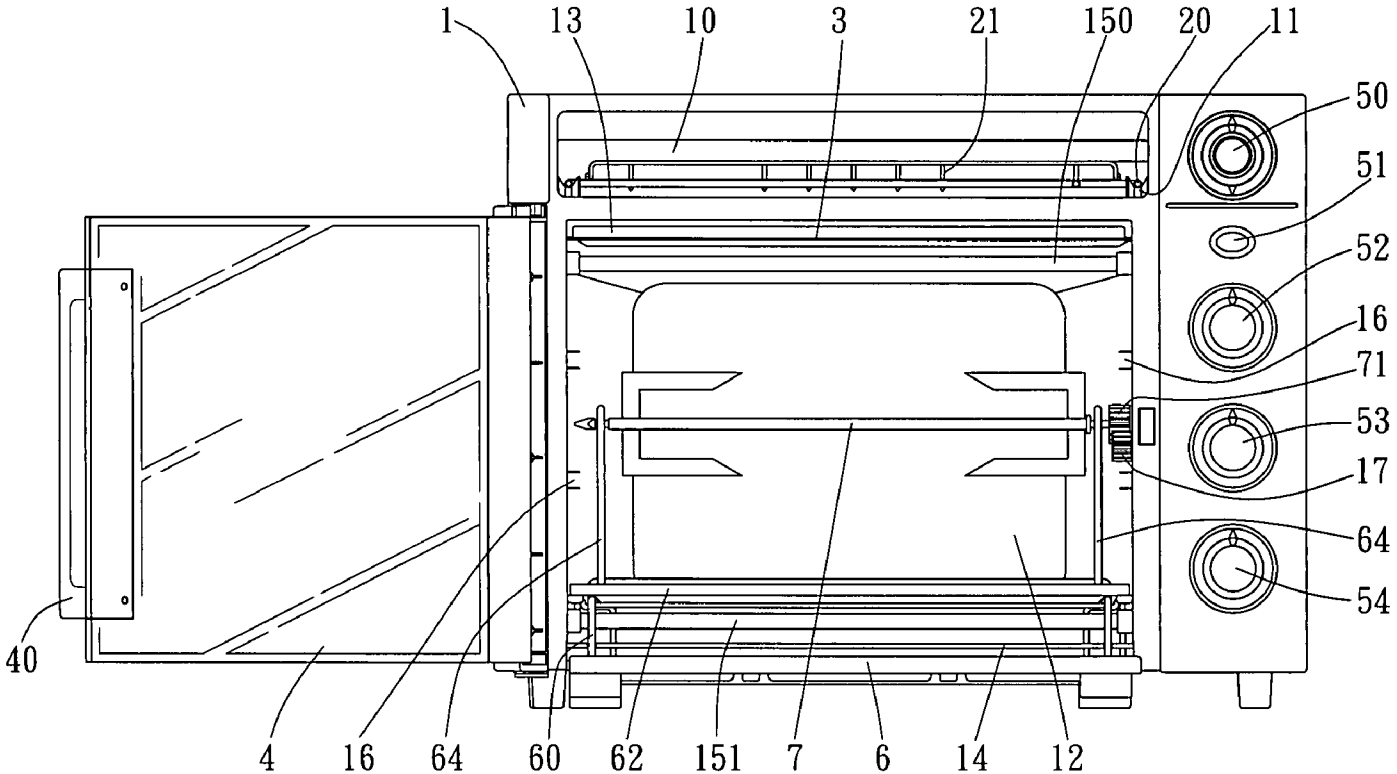
FIG. 4 is a front view of the preferred embodiment of an oven in the present invention.

As shown in FIGS. 1~3, a preferred embodiment of an oven in the present invention includes a main body 1, a toast tray 2, a baking pan 3, a door 4, a control panel 5, a bottom base 6 and a shaft 7.

The main body 1 is provided with an upper chamber 10 in the upper portion, a roller 11 at two sidewalls of the upper chamber 10 respectively, a lower chamber 12 in the lower portion, an inserting groove 13 set in an upper section of the lower chamber 12, a bottom plate 14 set in the bottom of the lower chamber 12, having two recesses 140 at its front edge, plural sandwiched grooves 16 set correspondingly on two sidewalls of the lower chamber 12 respectively, a driving gear 17 and plural air inlets 18 and plural heat dispersing holes 19 bored in a sidewall of the lower chamber 12. Further, the upper chamber 10 is provided with plural air openings 100 in the bottom for communicating with the lower chamber 12. The lower chamber 12 is provided with two upper electro thermal tubes 150 and two lower electro thermal tubes 151 installed respectively at its top and its bottom, and two stop strips 120 set respectively at its two sidewalls above the lower electro thermal tubes 151. One stop strip is aligned on a same level with the other at the other side.

The toast tray 2 set in the upper chamber 10 is provided with a frame 20 that has a right side and a left side respectively mounted on the rollers 11 of the main body 1, a metallic net 21 laid in the frame, a handle 22 fixed on the front side and a blocker 23 on one side edge near to the rear side.

The baking pan 3 is inserted in the inserting groove 13.

The door 4 pivotally installed at the front of the main body 1 is provided with a handle 40.

The control panel 5 set at the front side of the main body 1 is provided with an adjusting knob 50 located on the same level with the upper chamber 10, a change-over switch 51 built below the adjusting knob 50, and a function knob 52, a temperature knob 53 and a time knob 54 set below the change-over switch 51 orderly.

The bottom base 6, laid at the bottom of the main body 1 as shown in FIG. 2, is provided with a supporting rack 60, a pair of supporting rods 61 set pivotally at the rear side, a supporting plate 62 laid on the supporting rack 60 and having its two sides rested on the two stop strips 120 of the lower chamber 12, a pair of pivot bases 63 set on two sides respectively, and a pair of stands 64 having a groove 65 on its top respectively, pivotally connected with each pair of the pivot bases 63 so that it can swing down to rest on the supporting plate 62.

The shaft 7 resting on the stands 64 of the bottom base 6 is provided with a fork 70 near its two ends respectively, and a driven gear 71 at one end for engaging with the driving gear 17.

Figure 5:
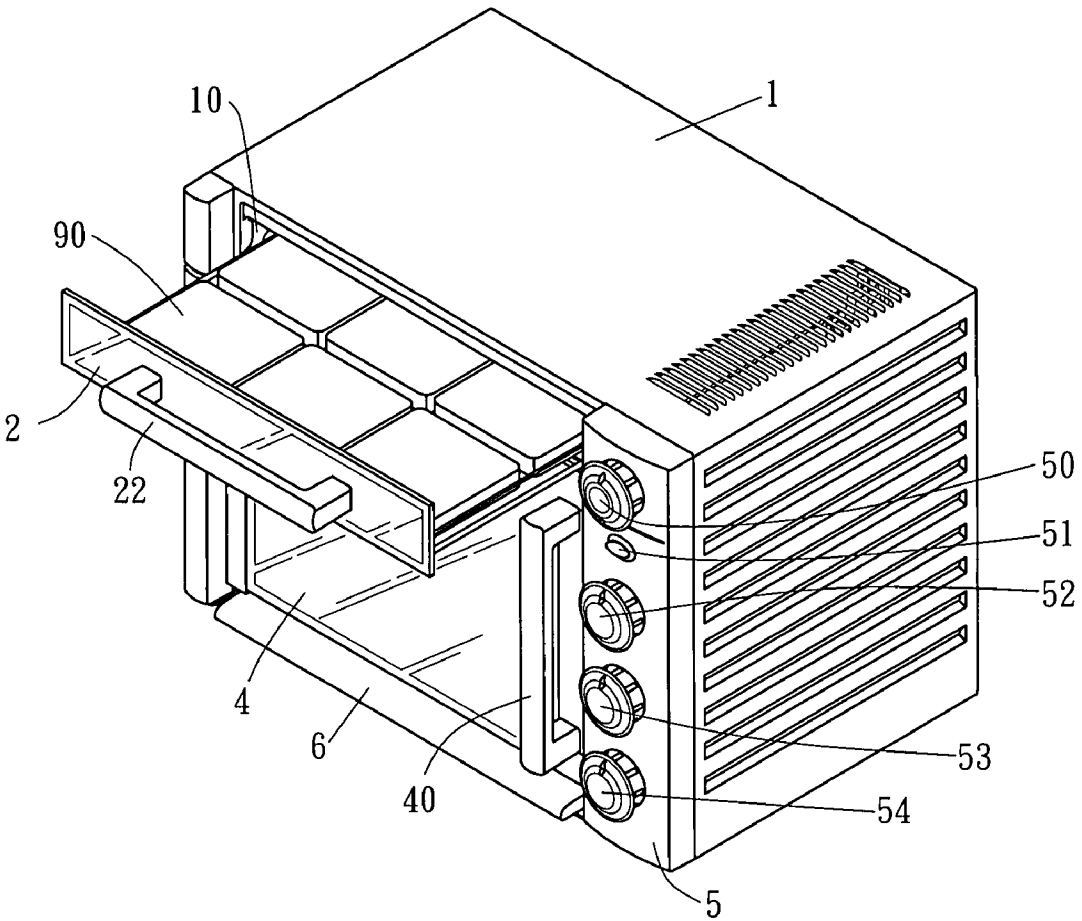
FIG. 5 is a perspective view of the preferred embodiment of an oven in the present invention, showing how to bake toasts.
Figure 6:
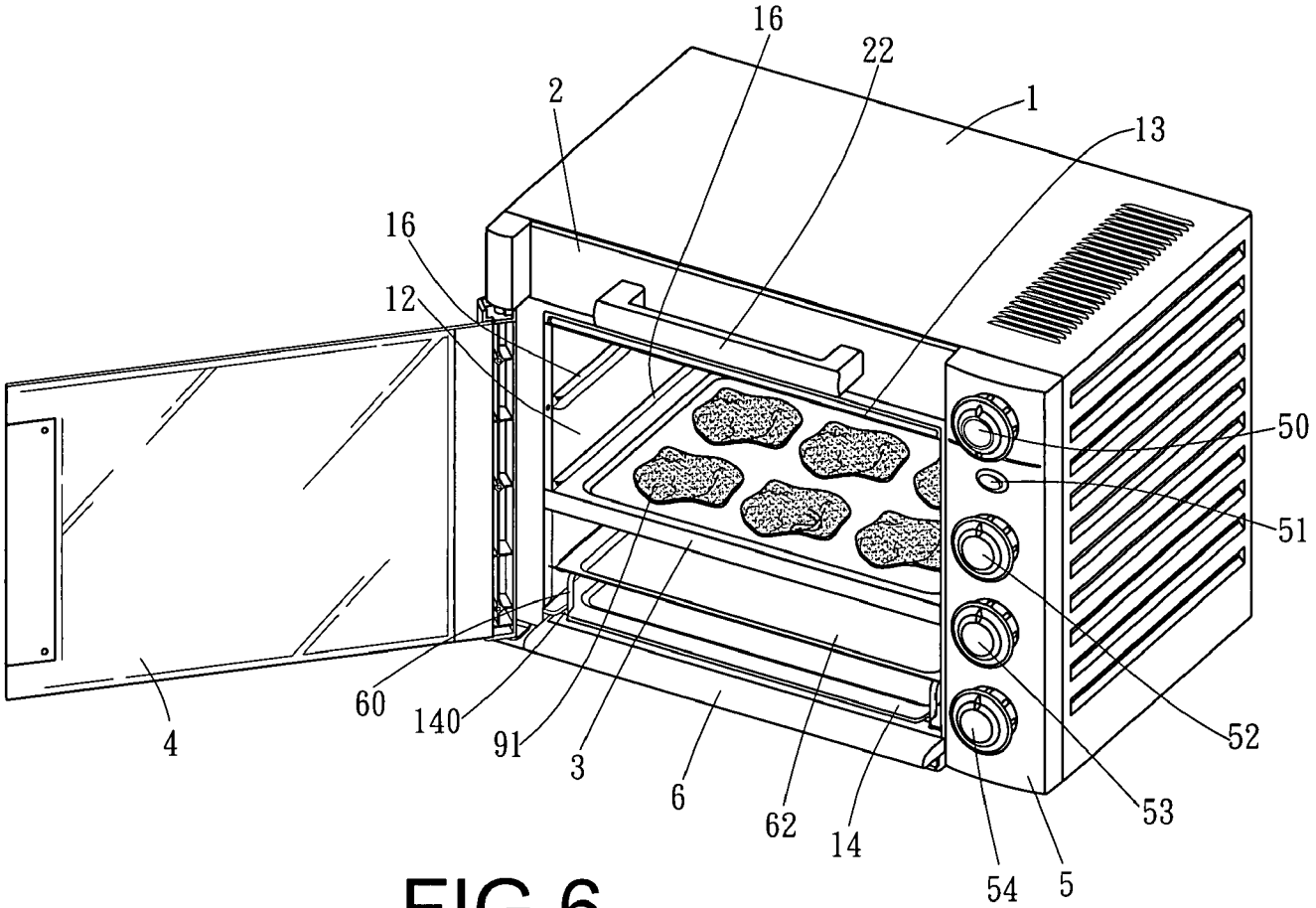
FIG. 6 is a perspective view of the preferred embodiment of an oven in the present invention, showing how to bake foods with small sizes.

In using, as shown in FIGS. 3–7, if toasts 90 are to be baked, a user only has to pull the toast tray 2 out of the upper chamber 10 of the main body 1, and put the toasts 90 on it, as shown in FIG. 5. In case of the toast tray 2 pulled out, the blocker 23 is able to stop and keep the toast tray 2 stabilized at a definite position, so a user does not have to worry about the toast tray 2 sliding off the oven. Then, the following successive actions are to push the toast tray 2 back into the upper chamber 10, to change the changeover switch 51 to a toast scale and to turn the adjusting knob 50 to select a desired baking condition. By the time, the upper electro thermal tube 150 is initiated to heat. The fine net 21 of the toast tray 2 can prevent crumbs from dropping onto the upper electro thermal tubes 150, otherwise the upper electro thermal tubes 150 could be damaged. If the fine net 21 is to be cleaned, just pull out the toast tray 2 and lift it up slightly to enable the blocker 23 to move over the rollers 11 to leave off the upper chamber 10, ready for cleaning. If foods with small size, such as meat or sausage rolls, are to be baked, as shown in FIG. 6, they can be put on the baking pan 3 pulled out in advance from the inserting groove 13, and then insert the baking pan 3 into the two corresponding sandwiched grooves 16. Next, close the door 4, and turn the changeover switch 51 to an oven scale, the function knob 52 to a desired scale, the temperature knob 53 to a desired temperature and the time knob to a desired period of time sequentially. By the time, the upper electro thermal tubes 150 and the lower electro thermal tubes 151 are simultaneously initiated to heat up. And, a fan (not shown in Figs.) in the main body 1 can blow through the air inlets 18 to keep air circulating in the lower chamber 12 to obtain an even temperature therein, so as to have foods evenly baked.

Figure 7:
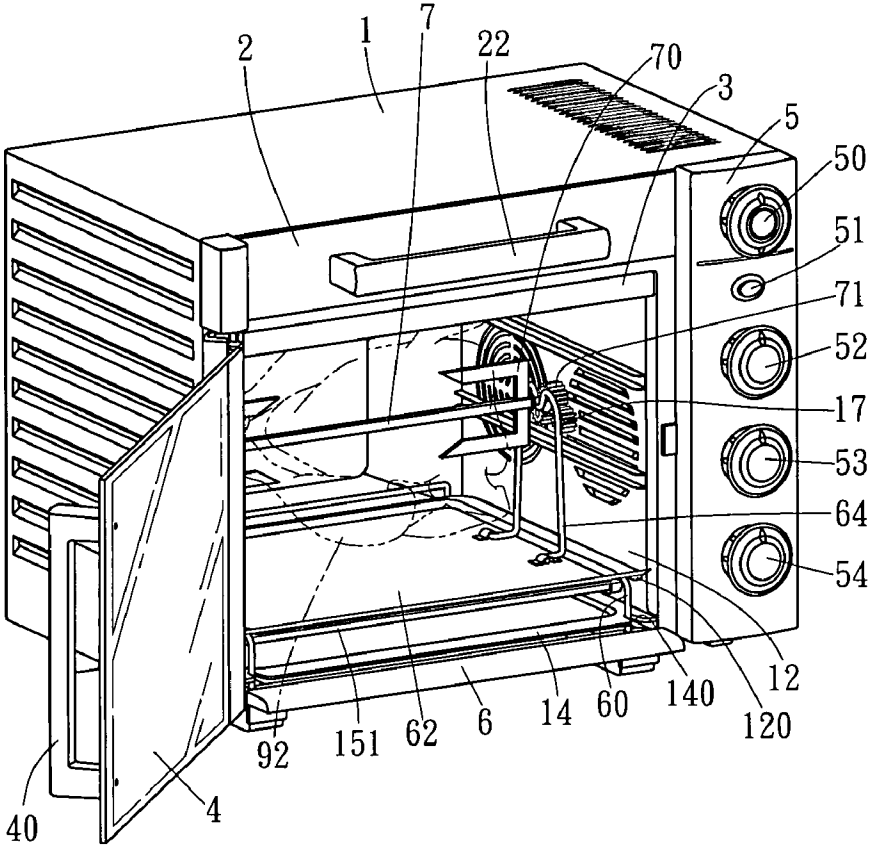
FIG. 7 is a perspective view of the preferred embodiment of an oven in the present invention, showing how to bake a whole chicken.

In addition, as shown in FIG. 7, if a bigger-sized of food such as a whole chicken is to be baked, it has to be centrally forked by the shaft 7 first. Next, swing up the stands 64 to stand vertically and keep two ends of the shaft 7 mounted on the grooves 65 of the stands 64, so that the whole chicken 92 is mounted stably on the bottom base 6. Then, push the bottom base 6 into the lower chamber of the main body 1. When the bottom base 6 is started to be moved in, the supporting rods 61 of the bottom base 6 are to swing down to rest on the bottom base 6 because they lean against the bottom plate 14, and the supporting plate 62 is to lie on the strip plates 120. And when the bottom base 6 is completely put in the lower chamber 12, the front feet of the supporting rack 60 are positioned in the recesses 140 of the bottom plate 14 and the driven gear 71 of the shaft 7 is engaged with the driving gear 17 in the lower chamber. By the time, the door 4 can be closed. Of course, the following steps are to turn the change-over switch 51 to oven reading, the function knob 52 to a desired baking condition, the temperature knob 53 and the time knob 54 to a needed scale orderly. The upper electro thermal tubes 150 and the lower electro thermal tubes 151 are automatically initiated to heat up. By means of the engagement of the driving gear 17 and the driven gear 71, the shaft 7 is to be rotated slowly and automatically while baking, enabling the whole chicken 92 baked evenly. When the baking time is up, just pull out the bottom base 6 after opening the door 4, and swing up supporting rods 61 to stand under the supporting rack 60 so as to support stably the supporting rack 60, as shown in FIG. 2. Next, the whole chicken 92 can be taken off. Moreover, when the stands 64 are not to be used, they can be swung down to rest on the supporting plate 62, never hindering a baking with the baking pan 3.

The invention has the following advantages as can be seen from the foresaid description.

1. By means of the changeover switch 51 that can select toasting or oven baking, the invention can be used for various purposes, possible to save money and space.

2. Because the shaft 7 can be rotated automatically while baking, a big object, such as a whole chicken, can be baked evenly without wasting energy as a conventional oven does.

3. It is convenient not only for using the invention, but also for cleaning it.

While the preferred embodiment of the invention has been described above, it will be recognized and understood that various modifications may be made therein and the appended claims are intended to cover all such modifications that may fall within the spirit and scope of the invention.

What is claimed is:

1. An oven comprising:

a main body provided with an upper chamber, a lower chamber, a roller set at two sidewalls of said upper chamber respectively, an inserting groove set at a top of said lower chamber, a bottom plate set at a bottom of said lower chamber, plural sandwiched grooves set correspondingly on two sidewalls of said lower chamber respectively, a driving gear installed and plural air inlets and plural heat dispersing holes bored in a sidewall of said lower chamber, said upper chamber provided with plural air openings on the bottom for communicating with said lower chamber, plural electro thermal tubes installed in said lower chamber, two stop strips set respectively at two sidewalls of said lower chamber above said lower electro thermal tubes, said one stop strip aligned on a same level with the other at the other side;

a toast tray set in the upper chamber and provided with a frame and a handle, a metallic net laid in said frame;

a baking pan inserted in said inserting groove;

a door pivotally installed at the front of said main body;

a control panel set on said main body and provided with plural knobs and a change-over switch;

a bottom base laid at the bottom of said main body and provided with a supporting rack, a supporting plate laid on said supporting rack, and two stands set properly spaced apart on said supporting plate and having a groove on its top respectively; and a shaft mounted on said stands of said bottom base and provided with a fork near its two ends respectively, a driven gear fixed at one end of said shaft and engaging with said driving gear.

2. The oven as claimed in claim 1, wherein said bottom plate of said main body is provided with two recesses at its front edge.

3. The oven as claimed in claim 1, wherein said lower chamber of said main body is provided with plural air inlets and plural heat dispersing holes on one sidewall.

4. The oven as claimed in claim 1, wherein said frame of said toast tray is provided with a blocker near its rear side.

5. The oven as claimed in claim 1, wherein said control panel is provided with an adjusting knob located correspondingly to face said upper chamber for baking toast, said change-over switch set below said adjusting knob, a function knob, a temperature knob and a time knob installed orderly below said switch.

6. The oven as claimed in claim 1, wherein said bottom base is provided with two supporting rods pivotally connected on the rear side, plural pivot bases set on said supporting plate for pivotally connected with said stands and enabling said stands to swing down to rest on said supporting plate.

* * * * *